US006328380B1

(12) United States Patent
du Rées

(10) Patent No.: US 6,328,380 B1
(45) Date of Patent: Dec. 11, 2001

(54) CHAIR ADJUSTMENT DEVICE

(75) Inventor: Stephan du Rées, Lidingö (SE)

(73) Assignee: Mercado Medic AG (SE)

( * ) Notice: Subject to any disclaimer, the term of this patent is extended or adjusted under 35 U.S.C. 154(b) by 0 days.

(21) Appl. No.: 09/367,646

(22) PCT Filed: Feb. 17, 1998

(86) PCT No.: PCT/SE98/00281

§ 371 Date: Sep. 13, 1998

§ 102(e) Date: Sep. 13, 1999

(87) PCT Pub. No.: WO98/35587

PCT Pub. Date: Aug. 20, 1998

(30) Foreign Application Priority Data

Feb. 18, 1997 (DE) ..... 9700581

(51) Int. Cl.[7] ..... A47C 1/023

(52) U.S. Cl. ..... 297/313; 297/326; 248/397; 248/371

(58) Field of Search ..... 297/313, 314, 297/325, 326; 248/397, 371

(56) References Cited

U.S. PATENT DOCUMENTS

| | | | | |
|---|---|---|---|---|
| 2,731,074 | * | 1/1956 | Steinle | 248/371 |
| 3,640,566 | | 2/1972 | Hodge . | |
| 4,153,294 | | 5/1979 | Meiller et al. . | |
| 4,445,661 | * | 5/1984 | Langmesser, Jr. et al. | 297/325 X |
| 4,460,144 | * | 7/1984 | Kazaoka et al. | 248/397 |

FOREIGN PATENT DOCUMENTS

| | | |
|---|---|---|
| 486863 | 4/1978 | (CH) . |
| 581818 | 10/1946 | (GB) . |

* cited by examiner

*Primary Examiner*—Anthony D. Barfield
(74) *Attorney, Agent, or Firm*—Ostrolenk, Faber, Gerb & Soffen, LLP

(57) ABSTRACT

A device for adjustment inclination of a chair seat has a spindle rotatable upon applying a torque and a seat bearing member, which is mounted on the spindle. The seat bearing member is displaceable axially along the spindle and pivotal about an axis which extends perpendicular to the spindle, to provide the chair seat with angular displacement.

9 Claims, 2 Drawing Sheets

CHAIR ADJUSTMENT DEVICE

FIELD OF THE INVENTION

The present invention relates to an adjustment device for chairs, especially chairs adapted to be used by handicapped persons, comprising a seat, which by means of the adjustment device can be set in different angular positions. The main surface plane of the seat can be inclined from a horizontal position both forwards and backwards for the purpose of achieving an adjusted position matching the intended use of the chair.

BACKGROUND OF THE INVENTION

Prior art chairs of similar type intended for use by persons suffering from different handicaps, especially spasticity, exhibit seats, which can be brought into different angular positions with the aid of various piston-cylinder arrangements. In this type of adjustment devices the piston movement in the cylinder is controlled by means of a manually operated valve and the device functions against a spring means continuously striving to tilt the seat into a position inclined forwards or backwards in response to the structural arrangement of the device. The most usual arrangement is that the structure with the aid of the spring member holds the seat in a forwards inclined position, which is altered when the control cylinder device is opened-by means of a lever and a person sits down on the seat. The angular position is then changed to an outer end position, somewhat inclined backwards. By actuation of the control lever for the cylinder device the seat can be brought into a desired position yielding a comfortable seating, the seat being then by the spring automatically tilted forwards into the position corresponding to release of the control lever for the piston-cylinder device. However, this technical solution has proved inconvenient to persons suffering from certain types of handicap, particularly spasticity. If the control lever is not handled correctly the result may be that the person can actually fall out from the chair.

SUMMARY OF THE INVENTION

The object of the present invention is to provide an adjustment device eliminating those drawbacks by offering a chair device permitting the seat to be in a stepless and simple manner brought into a desired position without any risk of actuation of its control device resulting in the seat tilting forwards to its extreme angular position where it is inclined forwards. This has been achieved by means of an adjustment device constituted by a threaded rod or adjustment spindle rotatable by means of a wheel and the threads of which have a pitch, which in combination with the rotation speed of the control wheel determines the position adjustment speed of the seat.

Thanks to the present invention there has been provided an adjustment device, which in an excellent way satisfies its purpose and by means of which the handicapped person can himself very easily adjust the chair seat to the desired position. An additional function of the device according to the invention is that, during and after the adjustment proper, the seat is always automatically maintained locked in exactly the latest selected position.

BRIEF DESCRIPTION OF THE DRAWING

A preferred embodiment of the invention will now be described in greater detail, reference being made to the attached drawings, in which.

DESCRIPTION OF THE PREFERRED EMBODIMENT

Figure 1:
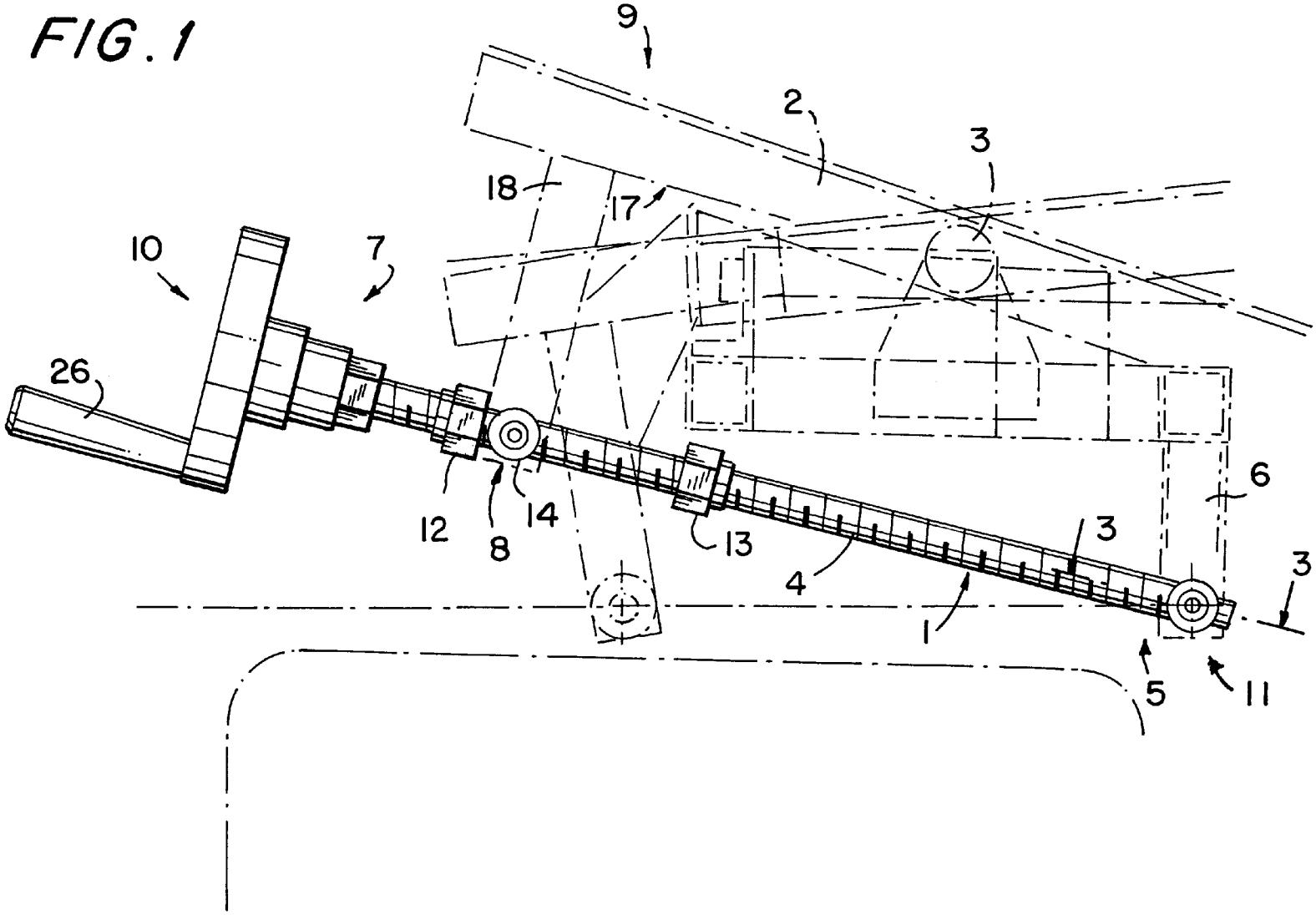
FIG. 1 is a diagrammatic partial lateral view of the adjustment device according to the invention mounted below a chair seat.
Figures 2, 3:
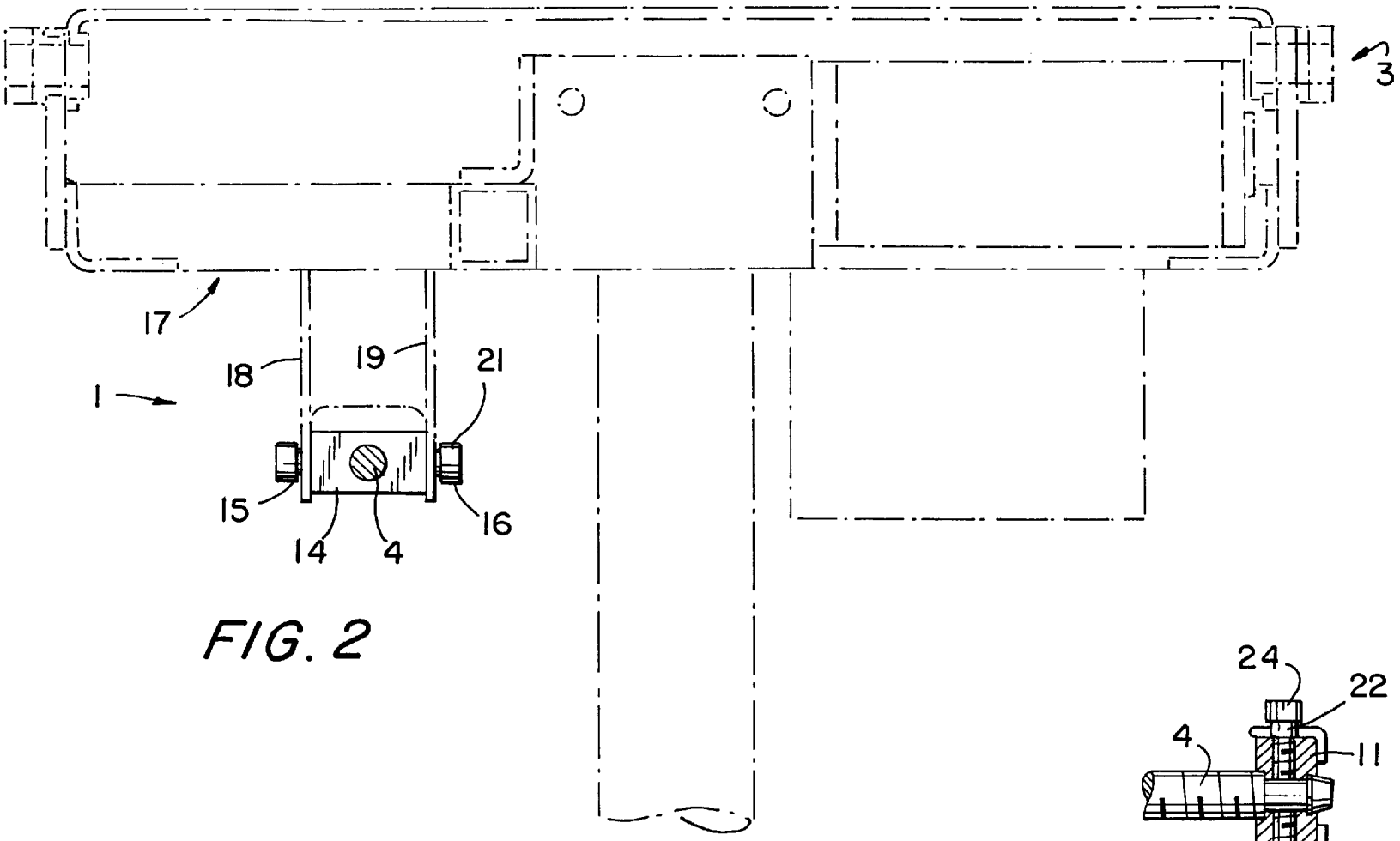
FIG. 2 is a diagrammatic partial end view of the adjustment device shown in FIG. 1
FIG. 3 illustrates how the adjustment device shown in FIGS. 1 and 2 can be mounted in the frame of a chair.

As appears most clearly from FIG. 1, an adjustment device 1 according to the present invention is mounted below a chair seat 2, the main surface plane of which can be inclined both forwards and backwards for the purpose of selecting a comfortable adjusted position for the seat 2. Stated in other words, the seat 2 is tiltable or pivotable around a turning shaft 3, which is mounted below the seat 2. According to the exemplifying embodiment this turning shaft 3 is located approximately centrally below the seat and extends in the transversal direction thereof. The adjustment device 1 consists of a control spindle 4, the one end 5 of which is rotatably mounted in the frame 6 of the chair 2 and the other end 7 of which is rotatably and, as counted in the longitudinal direction of the spindle 4, displaceably mounted by means of a nut member 8 in the front portion 9 of the seat 2 at a predetermined distance from the turning shaft 3. The opposite, second end 7 of the spindle 4 exhibits a wheel 10, by means of which the spindle 4 can be manually rotated either clockwise or counterclockwise in response to the desired inclination of the seat 2.

The one end 5 of the spindle 4 is rotatably mounted in the chair frame 6 by means of a frame bearing 11, in which the end 5 of the spindle 4 is rotatable. The bearing member 11 is in its turn rotatably mounted transversely to the longitudinal direction of the spindle 4. The other end 7 of the spindle 4 exhibits an outer and an inner adjustment nut 12 and 13, respectively, which by rotation can be displaced along the spindle 4 to a predetermined distance between themselves. This distance defines a movement distance along the spindle 4, within which, for the purpose of adjusting the inclination of the seat 2, a seat bearing member 14 supported by the seat 2 can be displaced in a stepless manner in response to rotation of the spindle 4. The seat bearing member 14 is rotatably supported by two pin bearing members 15 and 16, which it surrounds and which are mounted in fork supports 18 and 19 projecting from the bottom surface 17 of the seat 2. The fork supports 18 and 19 are by screws 20 and 21 held in fixed positions on the pin bearing members 15 and 16. In a similar fashion the frame bearing 11 exhibits two pins 22 and 23, which are rotatably mounted in the chair frame 6 and held secured by the screws 24 and 25.

The control wheel 10 on the spindle 4 does at its circumference have a handle 26 conveniently rotatably mounted to facilitate the manual rotation of the wheel 10 during adjustment of the seat 2. The nuts 12 and 13 can be set in desired positions defining the ends of the seat adjustment range corresponding to the intended use of the chair equipped with an adjustment device according to the invention.

What is claim:

1. An adjustment device which adjusts an angular position of a seat of a chair, the seat having a frame which extends along a longitudinal axis, the adjustment device comprising:

a turning shaft mounted on the frame, the turning shaft being rotatable about a turning axis, which extends transversely to the longitudinal axis, for angularly displacing the seat about the turning axis;

a spindle rotatable about a spindle axis which extends perpendicular to the turning axis, the spindle having a first end portion, which is mounted to the frame, and a second end portion, which is axially displaceable relative to the first end portion;

a seat bearing member mounted on the second end portion of the spindle and axially displaceable therewith relative to the first end portion as the spindle rotates, the seat bearing member being connected to the seat and pivotal about a member axis, which is parallel to the turning axis, as the seat bearing member moves axially, whereby the seat is displaced angularly upon applying a torque to the spindle.

2. An adjustment device as recited in claim 1, wherein the seat bearing member has two pin bearing members spaced from one another along the member axis.

3. An adjustment device as recited in claim 2, wherein the seat bearing member further comprises a support having a first end which is mounted on the two pin bearing members and displaceable along the spindle axis, and a second end which is attached to the seat.

4. An adjustment device as recited in claim 3, wherein the support includes two fork links, each of the fork links being pivotally mounted on a respective one of the pin bearing members as the seat bearing member moves axially along the spindle.

5. An adjustment device as recited in claim 1, further comprising two nuts mounted on the second end portion to have the seat bearing member located between the two nuts, the two nuts being displaceable along the spindle axis relative to one another to vary an axial distance therebetween for limiting axial displacement of the seat bearing member.

6. An adjustment device as recited in claim 1, wherein the first end portion of the spindle is provided with a frame bearing which extends transversely to the spindle axis.

7. An adjustment device as recited in claim 1, wherein the spindle further has a control wheel provided with a handle to which the torque is applied.

8. A chair comprising:

a seat pivotal about a seat axis;

a spindle rotatable about a spindle axis and provided with opposite ends, the spindle axis extending transversely to the seat axis;

spaced apart first and second supports attached to the seat and rotatably receiving the spindle; and a seat bearing member mounted on the spindle and connected to the first support, the seat bearing member being displaceable along the spindle during rotation of the spindle and being pivotal about a member axis, which is parallel to the seat axis, as the seat bearing member moves axially along the spindle for pivoting the seat about the seat axis.

9. An adjustment device which adjusts an angular position of a seat of a chair, the seat having a frame which extends along a longitudinal axis, comprising:

a turning shaft attached to the seat and mounted on the frame, the turning shaft being rotatable about a turning axis which extends transversely to the longitudinal axis;

a spindle rotatable about a spindle axis extending perpendicular to the turning axis upon applying a torque to the spindle, the spindle having a first end portion, which is mounted rotatably to the frame, and a second end portion movable axially relative to the first end portion;

a seat bearing member mounted on the second end portion of the spindle and axially displaceable therewith relative to the first end portion along the spindle axis as the spindle rotates, the seat bearing member being pivotal about a member axis, which is parallel to the turning axis, as it moves axially, whereby the seat is displaced steplessly and angularly about the turning axis upon applying the torque; and two nuts mounted on the second end portion such that the seat bearing member is located between the two nuts, the two nuts being displaceable along the spindle axis relative to one another to vary an axial distance therebetween for limiting axial displacement of the seat bearing member along the spindle.

* * * * *